United States Patent [19]

Keritsis

[11] Patent Number: 4,991,605

[45] Date of Patent: Feb. 12, 1991

[54] CONTAINER FOR ADDITIVE MATERIALS FOR SMOKING ARTICLES

[75] Inventor: Gus D. Keritsis, Richmond, Va.

[73] Assignee: Philip Morris Incorporated, New York, N.Y.

[21] Appl. No.: 342,239

[22] Filed: Apr. 24, 1989

[51] Int. Cl.[5] ..... A24D 3/04; A24F 5/04

[52] U.S. Cl. ..... 131/335; 131/341; 131/198.1; 131/198.2; 131/359; 128/200.21

[58] Field of Search ..... 131/335, 336, 341, 198.1, 131/198.2, 359, 337; 128/200.14, 200.19, 200.21

[56] References Cited

U.S. PATENT DOCUMENTS

| | | | |
|---|---|---|---|
| 726,037 | 4/1903 | Ferre . | |
| 809,662 | 1/1906 | Barnes . | |
| 2,124,130 | 7/1938 | Van Deventer . | |
| 2,808,057 | 10/1957 | Jaksch . | |
| 3,162,199 | 12/1964 | Moll, Jr. . | |
| 3,347,231 | 10/1967 | Chang . | |
| 3,428,049 | 2/1969 | Leake et al. . | |
| 3,463,166 | 8/1969 | Bennett et al. . | |
| 3,515,146 | 6/1970 | Nealis . | |
| 3,538,924 | 11/1970 | Pruysers . | |
| 3,596,665 | 8/1971 | Lindgard | 131/266 |
| 3,957,059 | 5/1975 | Rainer et al. | 131/10 R |
| 3,972,335 | 8/1976 | Tiggelbeck et al. | 131/267 |
| 4,149,548 | 4/1979 | Bradshaw | 131/170 |
| 4,284,089 | 8/1981 | Ray | 131/270 |
| 4,532,943 | 8/1985 | Nichols et al. | 131/336 |
| 4,601,298 | 7/1986 | Nichols et al. | 131/336 |
| 4,637,408 | 1/1987 | Rainer et al. | 131/331 |
| 4,649,941 | 3/1987 | Norman et al. | 131/336 |
| 4,649,944 | 3/1987 | Houck, Jr. et al. | 131/336 |
| 4,677,995 | 7/1987 | Kallianos et al. | 131/335 |
| 4,687,008 | 8/1987 | Houck, Jr. et al. | 131/335 |
| 4,765,347 | 8/1988 | Sensabaugh, Jr. et al. | 131/273 |
| 4,793,365 | 12/1988 | Sensabaugh, Jr. et al. | 131/194 |

FOREIGN PATENT DOCUMENTS 2026299 2/1980 United Kingdom .

*Primary Examiner*—V. Millin
*Assistant Examiner*—Jennifer L. Doyle
*Attorney, Agent, or Firm*—Robert M. Isackson

[57] ABSTRACT

A container for containing an additive material for modifying the characteristics of a smoking article. The container contains at least two components that are movable between a first position and a second position with respect to each other. In the first position the additive material is hermetically sealed inside the container during storage of the smoking article prior to use. The container is activated by moving the components of the container to the second position to provide air flow pathways through the container so that the additive material can modify the smoking article accordingly. The components may have perforations that are covered by cooperating overlapping portions of the components of the container in the first position and uncovered in the second position. Alternately, the container may include a sealed capsule containing the additive that is punctured by moving the components during activation.

12 Claims, 3 Drawing Sheets

CONTAINER FOR ADDITIVE MATERIALS FOR SMOKING ARTICLES

BACKGROUND OF THE INVENTION

This invention relates to the improved delivery of additive materials to smoking articles. More particularly, this invention relates to providing additive materials in sealed containers that are opened during use to modify the characteristics of smoking articles.

It is known to provide a smoking article with additive materials to modify the characteristics of the smoking article. Additive materials typically modify the characteristics of the smoking article by passing gases, more particularly the hot, gaseous by-products of combustion, through the portion of the smoking article containing the additive material.

For example, sodium and/or calcium permanganate $Ca(MnO_4)_2$ or $NaMnO_4$ with colloidal silica deposited onto silica gel or alumina has been incorporated into filter elements to reduce smoke components such as NO, HCN, etc., as are disclosed in U.S. Pat. Nos. 3,957,059 and 4,637,408 to which the reader is referred. Menthol and other flavorants deposited on carbon, silica, and other activated particles in the filter section of a smoking article have been used to impart a flavor or taste to the smoking article. It also is known to provide a smoking article having a substantially tasteless fuel element with a flavor generator that, upon exposure to heat, provides an aerosol or vapors of flavorants to give the article its desired characteristics.

One of the problems with adding additive materials to smoking articles is that the active agents of the additive materials deactivate or volatize with time so that they do not have the desired effect upon use. Further, flavorant materials may be extensively trapped by components of the smoking articles so that less than desired amounts are delivered to the smoker. For example, a significant amount of menthol is trapped on active carbon or in cellulose acetate fibers of a conventional cigarette. Adding excess additive materials to compensate for expected loss of activity or entrapment results in inconsistent products because of variations in storage time prior to use and the conditions under which the article is consumed. The rigorous controls over product storage conditions and shelf life that would be required to minimize the volatility or deactivity of the active agent in the additive material are not commercially practical.

Another problem is that the active agents deactivate with the absorption of moisture or other volatile materials during storage or can migrate to the wrapper or embed in the filter or carrier of the smoking article so that they will not modify the smoke characteristics as desired.

A problem with adding additive materials to filter portions of smoking articles is that the filter containing, for example, the carbon activated particles on which menthol is conventionally deposited is closer to the burning end of a smoking article than is desirable, thus resulting in inefficient or unsatisfactory use of or undesired combustion or pyrolysis of the additive.

Accordingly, there is a continuing need to provide for improving the effective and efficient delivery of additive materials for modifying the characteristics of smoking articles under widely varying storage conditions.

SUMMARY OF THE INVENTION

It is an object of this invention to provide a sealed container for containing an additive material for the modification of smoking articles to minimize the loss or degradation in efficacy of the additive material prior to use of the smoking device.

It is a further object of this invention to provide for a container that can be hermetically sealed for containing a smoke modifying additive material prior to use and unsealed to release the active agent to modify the smoking article characteristics being delivered to the smoker.

In accordance with this invention, there is provided a container for an additive material for modifying the characteristics of the smoking article upon activation. Broadly, the invention concerns a container having two conditions, a first condition that provides a sealed chamber that encapsulates an additive material, and a second condition that provides an air flow pathway through the chamber so that the additive material can modify the characteristics of the smoking article in accordance with the properties of the additive material. The container components are moved relative to each other to change between the first and second positions.

The container is configured to be located in the "smoke" stream of a smoking article, preferably proximate to or at the mouth end of the article. The container is preferably cylindrical having about the same outer dimensions as the smoking article, and may be wrapped by an overwrapper or tipping paper in a conventional manner. The precise location is a matter of design choice which depends, in part, upon the properties of additive material being used and the nature of the desired modification, and whether the smoking article is being consumed during the act of smoking as in a conventional cigarette, or provides aerosol or vapors as a result of a heat source and a heat activated source of flavorants.

In one preferred embodiment, the invention comprises two or more components that interfit in overlapping relationship so that, in the first condition, the components form an air impervious, sealed chamber, and in the second condition, the components provide air flow pathways through perforations in the container walls and the chamber. One of the components may have perforations that are covered by the other component in the first condition and uncovered in the second condition, whereby the uncovered perforations provide an air flow pathway through the container of additive material so that the characteristics of the smoking article can be modified.

In an alternate embodiment, the invention comprises an hermetically sealed capsule containing the additive material that is surrounded by movable elements which have sharp protruding elements extending toward the capsule. The movable elements form a container enveloping the sealed capsule. In the first condition, the movable elements and the sealed capsule are arranged with the sharp protruding elements proximate to, but not piercing or affecting the integrity of the sealed capsule. In the second condition, the movable elements are moved relative to each other so that the sharp protrusions pierce the capsule walls and provide an air flow pathway through the capsule and perforations in the movable elements.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

As shown in FIGS. 1-7, illustrative embodiments of the present invention comprise a container 100 for containing a selected additive material (not shown) having two conditions, a first condition that is air impervious or sealed and a second condition that provides for air flow pathways through container 100 so that the additive material can modify the characteristics of the smoking article in the desired manner.

Figure 1:
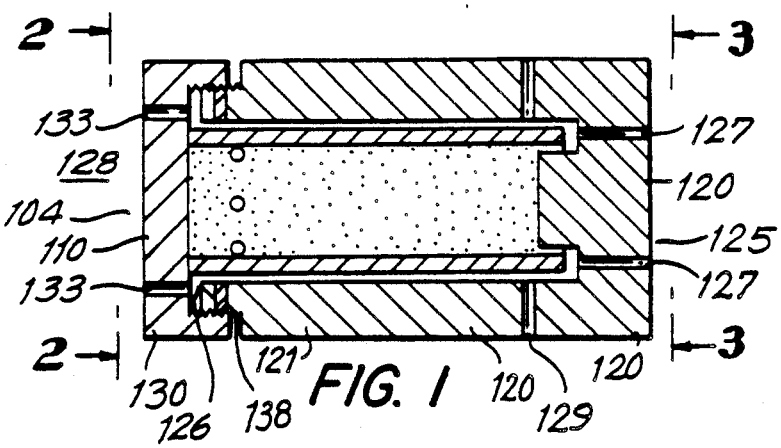
FIG. 1 is a cross sectional view of a container in accordance with a preferred embodiment of the present invention.
Figure 2:
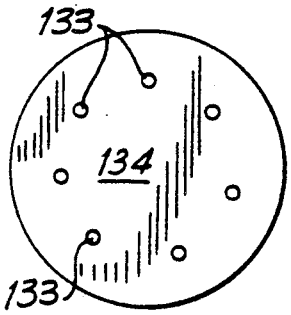
FIG. 2 is an end view taken along lines 2—2 of FIG. 1.
Figure 3:
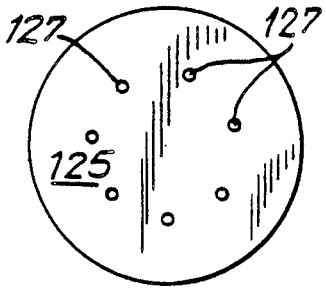
FIG. 3 is an end view taken along lines 3—3 of FIG. 1.

Referring to FIGS. 1-3, one embodiment of container 100 includes two elements 110 and 120 that interfit. Elements 110 and 120 are preferably cylindrical. Cylinder 110 includes a wall 111 and a cap 130. Wall 111 is secured concentrically to cap 130 at one end and is open at the other end defining a chamber for containing the additive material. The chamber is preferably cylindrical. Cap 130 contains a threaded wall 138 and perforations 133 in its surface 134 and extending into an area of cap 130 between threaded wall 138 and the location where wall 111 is connected to cap 130. Wall 111 includes a plurality of perforations 115 through its surface close to the end secured to cap 130. Perforations 115 are spaced about the periphery of wall 111 and are sealable by element 120 as described below.

Element 120 includes a shell 121 having a closed end 125 and an opening 126 that fits over wall 111 of element 110. Shell 121 is preferably cylindrical. Closed end 125 of element 120 has a plurality of perforations 127 that extend through end 125 and pass into .the interior of sleeve 121. Perforations 127 are preferably arranged about the perimeter of end 125 in a pattern selected to correspond to the configuration of wall 111 as described below. Close end 128 of element 120 has threads that screw into corresponding threaded wall 138 of cap 130 of element 110 to secure elements 110 and 120 together so that the wall 111 interfits with sleeve 121 of element 120.

When container 100 is in the first condition, i.e., closed to form a sealed chamber containing the additive material, elements 110 and 120 are screwed closed at cap 130 whereby the perforations 127 in end 125 of element 120 are covered by element 110 at the open end of wall 111, perforations 133 of cap 130 are covered by the element 120 at the open end of sleeve 121, and perforations 115 are covered by the wall of sleeve 121. As used herein, covered means closed off to form a substantially air impervious barrier.

Container 100 is activated, i.e., placed in the second condition so that the characteristics of the smoking article may be modified, by rotating (unscrewing) elements 110 and 120 relative to each other. Thus, in the second condition, perforations 133, 115 and 127 are uncovered to permit air flow therethrough and through the chamber defined by walls 111 and elements 110 and 120.

In an alternate embodiment (not shown), elements 110 and 120 could slideably and frictionally interconnect (without any threaded portions) so that activation would occur by pulling elements 110 and 120 apart a predetermined distance. Bumps and detents could be cooperatively used to control how far apart the elements are to be pulled to achieve the proper uncovering of the perforations.

Optionally, sleeve 121 of element 120 could contain perforations 123 or 129 extending to the interior of element 120 so that when elements 120 and 130 are in the first condition, the perforations are covered by wall 111 of element 110, and when the elements are in the second condition, the perforations 123 or 129 are uncovered and provide additional air passageways into the chamber from the perimeter of element 120. This latter embodiment is particularly useful when container 100 is secured in a smoking article by a material secured about element 120 so as to define an air flow path through the smoking article that must pass through container 100, preferably from one end to the other end. Perforations 123 or 129 would thus enhance the air flow capacity of container 100, the turbulence of the air flow through the chamber and the reaction of the gases with the additive materials.

Figure 4:
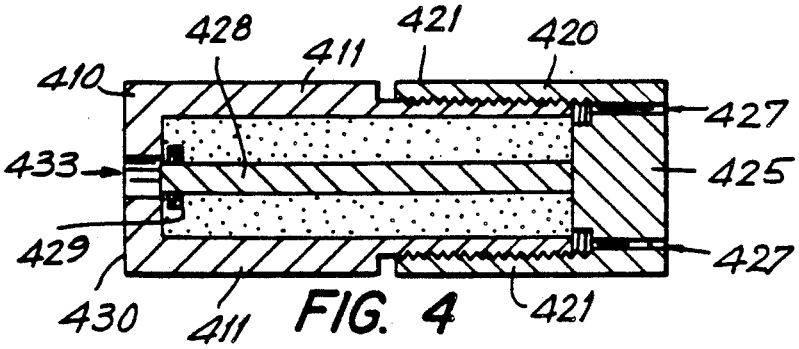
FIG. 4 is a cross sectional view of a container in accordance with a second embodiment of the present invention.

Referring to FIG. 4, an alternate form of the container of the present invention is shown. Container 400 includes two elements 410 and 420 having respective sleeves 411 and 421. Each of sleeves 411 and 421 are closed at one end and open at the other end. The sleeves are configured so that sleeve 421 overlaps sleeve 411 whereby sleeve 411 and the closed end portion of sleeve 421 define a chamber for containing an additive material. Element 411 includes a perforation 433 at end 430. Element 420 includes a post 428 extending from end 425 and passing along the length of sleeve 411 interior to the chamber, and perforations 427 through end 425 in a pattern that corresponds to the open end of sleeve 411.

In this embodiment, in the first condition, sleeves 411 and 421 interfit so that the end of sleeve 411 covers perforations 427 in end 425 of element 420 and the end of post 428 covers the perforation 433 in element 410. Activation of container 400 occurs by pulling elements 410 and 420 apart a distance sufficient to uncover perforations 433 and 427 to permit air flow therethrough and through container 400.

Optionally, post 428 may be configured to extend partially through perforation 433 when container 400 is in the first condition and to have a plug 429 that covers perforation 433 so that when container 400 is activated and elements 410 and 420 are pulled apart, post 428 remains within perforation 433 in a manner that does not interfere substantially with the air flow through container 400. Post 428 also could have a tapered end (not shown) so that the air flow through container 400 can be controlled by the user of the smoking article by controlling the size of the gap between post 428 and perforation 433. The gap may be selected by selecting how far elements 410 and 420 are pulled apart.

Figure 5:
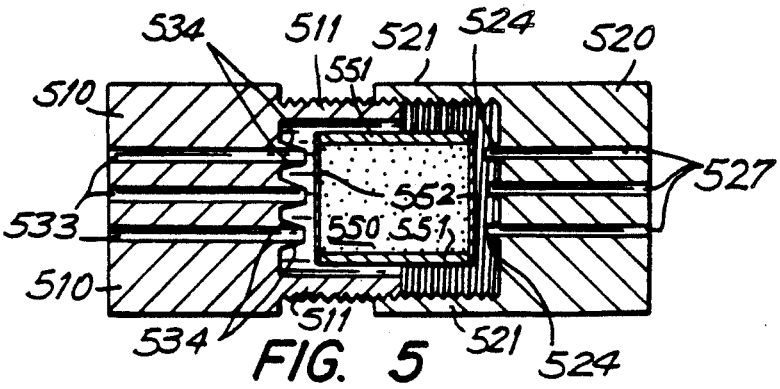
FIG. 5 is a cross sectional view of a container in accordance with a third embodiment of the present invention.

Referring to FIG. 5, an alternate embodiment of the container of the present invention is shown. Container 500 includes elements 510 and 520 and sealed capsule 550 containing an additive material. Element 510 is configured as a cylindrical element having a sleeve 511 and a plurality of perforations 533 extending through the body of element 510 that end in protrusions 534 at the end proximate to sleeve 511. Element 520 includes a sleeve 521 and a plurality of perforations 527 extending through the body of element 520 that terminate in protrusions 524 proximate to sleeve 521. Sleeves 511 and 521 are configured to interfit so that sleeve 521 overlaps sleeve 511. Protrusions 534 and 524 are sharp elements projecting from the edges of the perforations that are capable of penetrating and passing through the walls of capsule 550 presented to the protrusions.

Capsule 550 is hermetically sealed with the additive material inside and preferably has cylindrical side walls 551 and relatively thin flat end walls 552. Capsule 550 is placed inside sleeve 511 and may be temporarily secured to sleeve 511 so that the integrity of the seal is not accidentally compromised during shipping or storage of the smoking articles. In the first condition, container 500 is assembled so that capsule 550 is at least partially interior to sleeve 511 which is in turn at least partially interior to sleeve 520 so that capsule 550 is enveloped by both sleeves and remains hermetically sealed.

To activate container 500, elements 510 and 520 are urged towards each other, either by sliding the sleeves or rotating the elements if the sleeves are provided with cooperating threaded surfaces, so that protrusions 534 and 527 penetrate and puncture walls 552 of capsule 550, thereby providing air flow pathways through perforations 533, capsule 550, perforations 527 and container 500.

Figure 6:
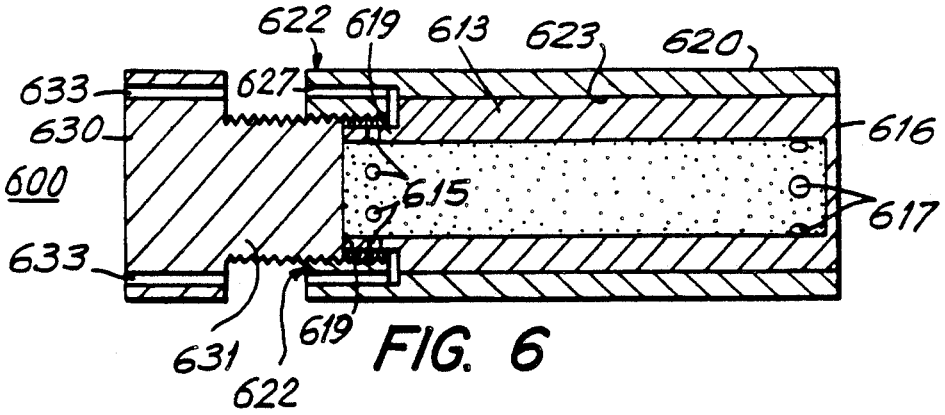
FIG. 6 is a cross sectional view of a container in accordance with a fourth embodiment of the present invention.
Figure 7:
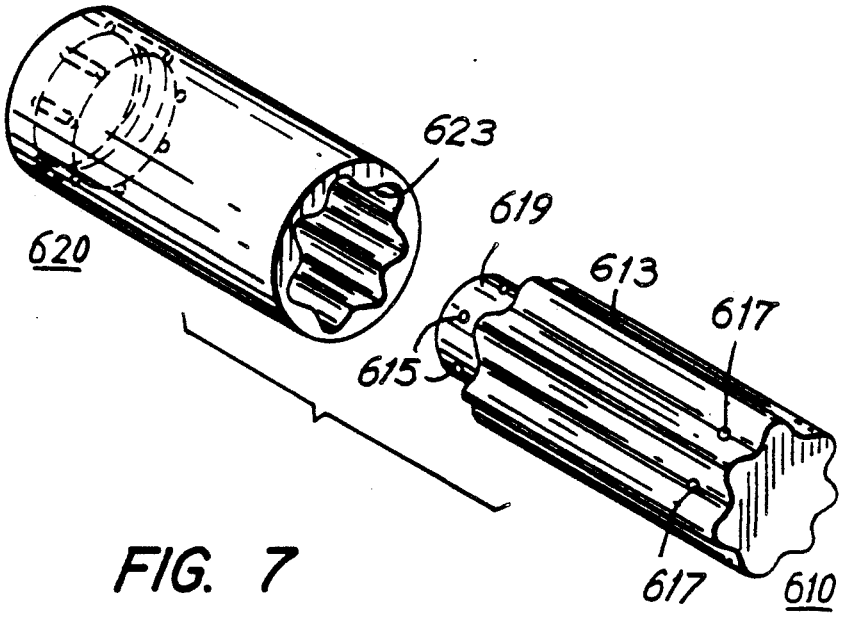
FIG. 7 is an exploded perspective view of portions of FIG. 6.
Figure 6A:
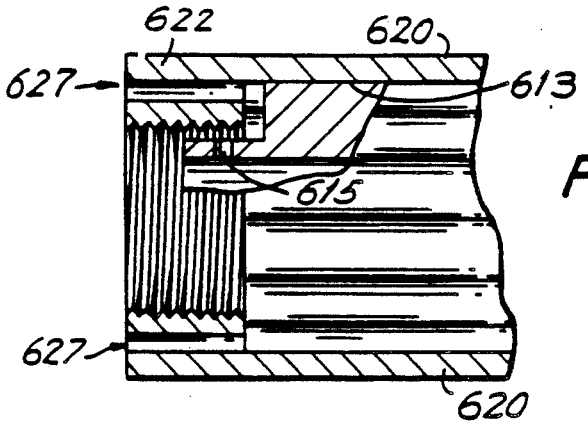
FIG. 6A is a partial sectional view of FIG. 6.

Referring to FIGS. 6, 6A, and 7, an alternate embodiment of the container of the present invention is shown. Container 600 includes elements 610, 620, and 630. Elements 610 and 620 are preferably cylindrical and configured to interfit. Element 620 is open at one end and threaded at the opposite end to receive element 630. Element 620 also has an axially grooved inner surface 623 that fits into a corresponding axially grooved outer surface 613 of element 610, a lip 622 at the open end, and perforations 627 extending through lip 622 substantially parallel to the longitudinal axis of element 620, but extending all the way therethrough. The arrangement of perforations 627 is selected to be in phase with the axial grooved surface 613 of element 610 to block an air flow pathway through perforation 627 and the axial grooves, as described below, when in the closed position.

Element 610 is open at one end and closed at the other end by surface 616, and contains perforations 615 and 617 in the periphery at the open and closed ends respectively. Perforations 617 are located in the valleys of the grooved surface at the closed end and perforations 615 are located on a smooth surface 619 at the open end, in front of grooved surface 613, which surface 619 circumscribes a smaller dimension than grooved surface 613 and is configured to fit inside lip 622 of element 620. Alternately, the open end of element 610 could be closed.

Element 630 forms a cap that covers the open end of element 620 by means of threaded member 631 which interfits with the threaded walls of lip 622. Element 630 includes perforations 633 extending through element 630 that are in phase with perforations 627 of element 620.

In the first condition, perforations 615 are covered by the interior wall of lip 622 and perforations 617 are covered by the corresponding grooved surface 623 of element 620. When container 600 is activated by rotating (or sliding) element 630, element 610 is axially pushed away from element 620 as element 630 is moved closer to element 620 so that the covered perforations are opened to allow air pathways through the inside of element 610. Perforations 615 become in open communication with perforations 627 and 633 through the perforated walls of element 630 and lip 622 of element 620 axially grooved surface, and perforations 617 become in open communication with the atmosphere once the perforations are moved beyond the length of the covering portions of the opposing grooved surfaces of element 620.

In an alternate embodiment, element 630 may be secured to element 610. In another embodiment, element 630 may be slideably engaged with element 620 so that activation of container 600 occurs by sliding element 620 longitudinally, relative to element 630 (and element 610) or vice versa whereby sliding element 630 longitudinally relative to element 620 will slide element 610 relative to element 620.

Figure 6B:
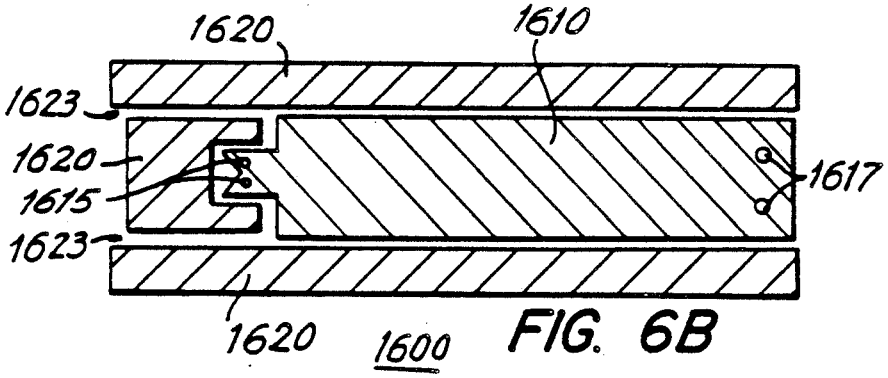
FIG. 6B is a partial sectional view of an alternative form of the embodiment of FIG. 6.

In yet another embodiment, referring to FIG. 6B, container 1600 includes two interfitting elements 1610 and 1620 that form a chamber. Element 1620 has a closed end, an open end and an interior cavity. Perforations 1623 extend through the closed end to the interior cavity of element 1620. The closed end has a receptacle interior to element 1620 to receive a portion of element 1610 as described below.

Element 1610 is configured to interfit closely interior to and in sliding relationship with element 1620. Element 1610 has a closed end, a second end and an interior cavity. The closed end of element 1610 is disposed to be proximate to the open end of element 1620. The second end is configured to interfit with and be covered by the receptacle of element 1620. Preferably, the second end is a length of the cylindrical body of element 1610 that has a smaller diameter than the rest of element 1610. Elements 1620 and 1610 may have the cooperating axial grooves as described in connection with FIG. 7.

Element 1610 has perforations 1615 extending to the interior at the second end and perforations 1617 extending to the interior at the closed end. When container 1600 is sealed, perforations 1615 are covered by the receptacle of element 1620 and perforations 1617 are covered by the body of element 1620. In the activated condition, elements 1610 and 1620 are moved apart so that perforations 1615 and 1617 are uncovered and there is air flow through perforations 1623, 1615, and 1617 through the chamber.

Containers of the present invention may be used in any smoking article where it is desirable to modify the characteristics by use of an additive material. The perforations are sufficient to provide adequate air flow through the container to modify the characteristics. Preferably, there is substantially no pressure drop across the container when the container is activated. In some cases, however, depending on the amount of space, fill, shape and size of the carrier granules, some pressure drop may be appropriate, for example, less than about one inch of pressure drop. Typical dimensions for a container are a length of from about 5 to about 25 mm and a circumference of from about 16 to about 28 mm. Configurations other than cylindrical containers could be used depending upon the type and physical dimensions of the smoking articles in which the container is placed.

Figure 8:
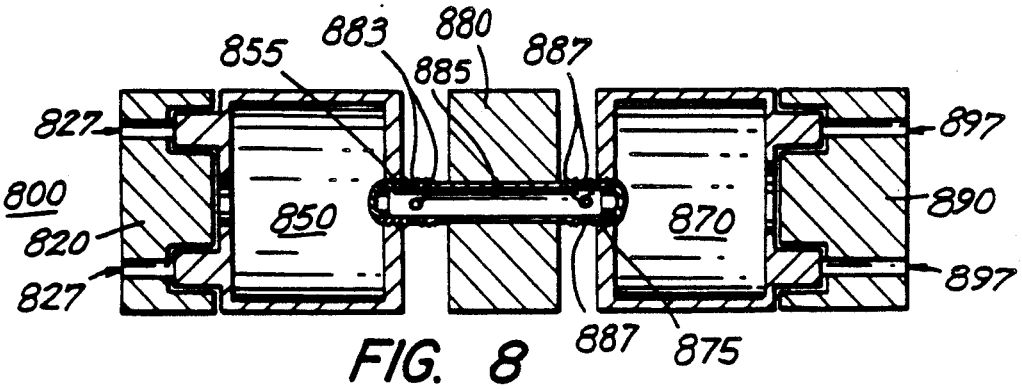
FIG. 8 is a cross sectional view of a container in accordance with a fifth embodiment of the present invention.

Referring to FIG. 8, the container may include more than one sealed chamber, for example, two chambers arranged in series. This configuration permits incorporating incompatible materials, such as the smoke modifier materials referred to in U.S. Pat. Nos. 4,637,408 or 3,957,059 and a flavor composition such as menthol, in the same article. In this embodiment, container 800 includes chambers 850 and 870 separated by plug 880 having integral tube 885 extending therethrough. Tube 885 is closed at its ends and includes a first plurality of perforations 883 at one end proximate to chamber 850 and a second plurality of perforations 887 at the other end proximate to chamber 870. An air flow pathway exists through perforations 883 and 887 interior to tube 885.

Tube 885 is double threaded to interfit with threaded aperture 855 in chamber 850 and threaded aperture 875 in chamber 870 respectively, so that rotating plug 880 and tube 885 relative to chambers 850 and 870 causes chambers 850 and 870 to rotate about the threads of tube 885 to move towards each other. In this manner perforations 883 pass into chamber 850 and perforations 887 pass into chamber 870, thereby placing the chambers in open communication, i.e., in an activated condition. Chamber 850 interfits with fixed element 820 having perforations 827 and chamber 870 interfits with fixed element 890 having perforations 897, thereby providing an air passageway through chambers 850 and 870 when container 800 is activated. An alternate embodiment (not shown) could include a plurality of chambers arranged in parallel.

Appropriate smoking articles into which the present invention may be incorporated include conventional tobacco containing smoking articles, articles that deliver uncombusted air, or uncombusted aerosol or substantially tasteless gases to the smoker and such other smoking articles, for example, as are described in European Patent Applications Nos. 0 277 355, 0 212 234, and 0 254 848, U.S. Pat. No. 4,714,082, U.S. Pat. No. 4,284,089, commercial products sold under the trade name Premier by R.J. Reynolds Tobacco Co., Winston-Salem, N.C., and commonly assigned U.S. Pat. Nos. 4,830,478 and co-pending application Ser. No. 07/222,831.

Any appropriate additive material or combination of materials could be contained inside the container of the present invention to modify the characteristics of the smoking article, particularly additive materials having active agents that deactivate over time or in moist or humid storage condition, or that evaporate or volatize or migrate during prolonged storage conditions. Such materials include, but are not limited to, sodium permanganate, calcium permanganate, menthol, anethol, tobacco acids such as $\beta$-methyl valeric acid, tobacco volatile bases such as pyrazines, and the like. The amount of additive materials to be added depends upon the desired flavor and tar delivery characteristics of the article. For example, for a full flavor product having about 15–17 mg FTC tar delivery, up to 5 mg of menthol may be added.

Advantageously, the present invention provides for improved placement of the additive material relative to the other components of the smoking article so that more effective and efficient use of the additive material can be obtained. For example, flavorant materials may be placed downstream of the filter materials, as far as possible from the burning portions of the articles thereby to minimize any thermal degradation of the flavorant and to maximize consumption of the flavorant.

The present invention also provides for controlled and sustained flavor delivery when the article is smoked, whether fresh or after storage, by substantially eliminating migration of flavorants to packaging materials or out of the package prior to use, preventing oxidation or deactivation of flavorants by reacting with certain other materials in the smoking article, minimizing any entrapment of flavorants, and preventing deactivation of various smoke modifiers by organic vapors that themselves deactivate the smoke modifiers, e.g., $NaMnO_4$, thus making the additive ineffective for reducing NO in the smoke and the oxidized organic vapors (e.g., flavors) producing an off flavor, rather than the desired effects.

One skilled in the art will appreciate that the present invention can be practiced by other than the described embodiments, which are presented for purposes of illustration and not of limitation and the present invention is limited only by the claims which follow.

I claim:

1. A container for an additive material for modifying the characteristics of a smoking article comprising:

a first element having a first end, a second end, and a side wall between said first and second ends defining a chamber for containing the additive material, said first element having a first perforation proximate to its first end and a second perforation proximate to its second end for forming an air pathway through the chamber of said first element;

a second element having a first end, a second end, and a side wall between said first and second ends, said second end being open and a portion of the side wall of said second element extending over a length of the side wall of said first element; and means for movably interconnecting said first and second elements between a first and a second position, said first position having said first and second perforations covered to form an air impermeable chamber when said smoking article is being stored, said second position having said first and second perforations uncovered so that there is an air flow pathway through said chamber whereby the additive material can modify the characteristics of the smoking article when the article is being used.

2. A container for an additive material for modifying the characteristics of a smoking article comprising:

a first element having a closed end, side walls, and an open end defining a chamber for containing said additive material, said first element having a first perforation extending through said first element proximate to said closed end;

a second element having a closed end, a side wall, and an open end, said second element having a second perforation extending through said second element proximate to said closed end;

means for movably interconnecting said first and second elements so that said respective side walls overlap in close relation between one of a first and second positions, said first position providing an hermetically sealed chamber for containing said additive material, said second position providing air flow pathways through said chamber so that said additive material can modify the characteristics of the smoking article.

3. The container of claims 2 wherein in said first position, said first perforation is covered by a portion of said second element overlapping said first element and said second perforation is covered by a portion of said first element overlapping said second element thereby forming said sealed chamber and in said second position said first and second perforations are uncovered so that there is an air flow pathway therethrough and through said chamber.

4. The container of claim 3 wherein said means for movably interconnecting said first and second elements further comprises interconnecting the first and second elements by cooperating threaded surfaces whereby the elements are moved between the first and second position by rotating the first and second elements relative to each other.

5. The container of claim 4 wherein said closed end of said first element further comprises a threaded cap having a threaded wall exterior to and overlapping the side wall of the first element and a third perforation extending through said cap exterior to said side wall of the first element and interior to said threaded wall, said third perforation being covered by a portion of said second element when said first and second elements are in said first position and uncovered when said first and second elements are in said second position so that said air flow pathway includes said third and first perforations.

6. The container of claim 5 wherein said second element further comprises a fourth perforation proximate to said open end, said fourth perforation being covered by said threaded wall of said first element when said first and second elements are in said first position and uncovered when said first and second elements are in said second position so that said air flow pathway includes said first, third, and fourth perforations.

7. The container of claim 3 wherein said second perforation is in said closed end of said second element.

8. The container of claim 7 wherein said second element further comprises a fifth perforation in said side wall proximate to said closed end of said second element, said fifth perforation being covered by said first element when said first and second elements are in said first position and uncovered when said first and second elements are in said second position so that the air flow pathway includes said open end of said first element and said second and fifth perforations.

9. A container for an additive material for modifying the characteristics of a smoking article comprising:

a first cylindrical element having a closed end, side walls, and a second end defining a chamber for containing said additive material, said side walls having an exterior surface including a smooth portion and a grooved portion, said grooved portion having a plurality of grooves extending axially along the surface of said cylindrical element, said smooth portion being proximate to said second end and having a first perforation extending therethrough into said chamber, said grooved portion having a second perforation proximate to said closed end extending therethrough;

a second cylindrical element having a first end, side walls, and an open end, said side walls having an interior grooved surface having a plurality of grooves extending axially along the interior surface, said interior grooves corresponding to and cooperating with said exterior grooves of said first cylindrical element, said first end having a second perforation extending therethrough and a second interior surface; and means for movably interconnecting said first and second elements so that said respective interior and exterior grooved portions of said respective side walls overlap in phase in close relation between one of a first and second positions, said firs position having said first perforation covered by a grooved portion of said second element overlapping said first element and having said second perforation covered by said second interior surface of said second element, and having said open end of said first cylindrical element covered, said second position having said first and second perforations uncovered so that there is an air flow pathway therethrough and through said chamber.

10. The container of claim 9 wherein said second interior surface of said second element is threaded and wherein said means for movably interconnecting said first and second elements further comprises a cap member having a boss with a threaded outer surface for threadably interconnecting with said threaded second interior surface of said second element, a flange having a dimension greater than said boss surface, and a third perforation passing through said flange, said cap being movable between said first and second positions by rotating said cap and second element relative to each other.

11. The container of claim 10 wherein said open end of said first element is covered by the boss surface of said cap.

12. The container of claim 9 wherein said second perforation is in a valley of said exterior grooved surface of said first element.

* * * * *

UNITED STATES PATENT AND TRADEMARK OFFICE

CERTIFICATE OF CORRECTION

PATENT NO. : 4,991,605

DATED : February 12, 1991

INVENTOR(S) : Gus D. Keritsis

It is certified that error appears in the above-indentified patent and that said Letters Patent is hereby corrected as shown below:

Column 1, line 21, "onto" should be -- on --.

Column 3, line 63, ".the" should be -- the --.

Column 3, line 67, "Close" should be -- Closed --.

Column 4, line 56, "411" should be -- 410 --.

Column 7, line 59, "Nos." should be -- No. --.

Column 7, line 60, "4,830,478" should be -- 4,991,606 --.

Claim 3, column 9, line 16, "claims" should be -- claim --.

Claim 3, column 9, line 21, "chamber" should be -- chamber, --.

UNITED STATES PATENT AND TRADEMARK OFFICE

CERTIFICATE OF CORRECTION

PATENT NO. : 4,991,605

DATED : February 12, 1991

INVENTOR(S) : Gus D. Keritsis

It is certified that error appears in the above-indentified patent and that said Letters Patent is hereby corrected as shown below:

Claim 9, column 10, line 31, "firs" should be -- first --.

Signed and Sealed this

First Day of March, 1994

Bruce Lehman

*Attest:*

BRUCE LEHMAN

*Attesting Officer*

*Commissioner of Patents and Trademarks*